US006735889B1

(12) United States Patent
Berger et al.

(10) Patent No.: US 6,735,889 B1
(45) Date of Patent: May 18, 2004

(54) SKID STEER LOADER NEUTRAL DRIFT CORRECTION METHOD

(75) Inventors: John G. Berger, Landisville, PA (US); John R. Haupt, Lititz, PA (US)

(73) Assignee: New Holland North America, Inc., New Holland, PA (US)

( * ) Notice: Subject to any disclaimer, the term of this patent is extended or adjusted under 35 U.S.C. 154(b) by 46 days.

(21) Appl. No.: 10/341,461

(22) Filed: Jan. 14, 2003

(51) Int. Cl.[7] ..... E02F 9/20
(52) U.S. Cl. ..... 37/348; 701/50
(58) Field of Search ..... 37/347, 348, 414, 37/382; 701/50, 53, 56; 172/2–12; 180/333; 417/212, 213, 216; 414/695–700, 715, 720

(56) References Cited

U.S. PATENT DOCUMENTS

| | | | |
|---|---|---|---|
| 4,871,044 | A | 10/1989 | Strosser et al. |
| 4,986,108 | A | 1/1991 | Wilde |
| 5,012,415 | A | 4/1991 | Boe et al. |
| 5,472,056 | A | 12/1995 | Orbach |
| 5,918,195 | A | 6/1999 | Halgrimson et al. |
| 5,924,516 | A | 7/1999 | Sagaser et al. |
| 6,047,228 | A | 4/2000 | Stone et al. |
| 6,076,030 | A | 6/2000 | Rowe |
| 6,140,787 | A | 10/2000 | Lokhorst et al. |
| 6,202,014 | B1 | 3/2001 | Brandt et al. |
| 6,256,566 | B1 | 7/2001 | Kamiya et al. |
| 6,293,033 | B1 | 9/2001 | Moriya et al. |
| 2001/0007087 | A1 | 7/2001 | Brandt et al. |

*Primary Examiner*—Robert E. Pezzuto
(74) *Attorney, Agent, or Firm*—John William Stader; Collin A. Webb

(57) ABSTRACT

A method of manual control neutral drift correction for a work vehicle is characterized by the steps of: sensing a position of a first manual control using a first position sensor when an activation switch is activated, wherein the first position sensor generates a first input signal; sending the first input signal to a controller; retrieving a stored first manual control neutral position value from a memory unit; calculating a first corrected manual control neutral position value using the controller, wherein the first corrected manual control neutral position value is calculated using the first input signal and the first manual control position value; and utilizing the first corrected manual control neutral position value to generate a first control signal for operating a first electro-hydraulic valve, wherein the first control signal is generated by the controller to operate the first electro-hydraulic valve to effect movement of a first assembly.

29 Claims, 3 Drawing Sheets

SKID STEER LOADER NEUTRAL DRIFT CORRECTION METHOD

FIELD OF THE INVENTION

The present invention relates to the calibration of a neutral position for hand or foot manual controls such as would be used in a work vehicle, such as, for example a mini excavator or skid steer loader. In particular, the present invention relates to an apparatus and method automatically correcting sensor output drift utilizing a "moving average" to correct for control and position sensor drift.

BACKGROUND OF THE INVENTION

Skid steer loaders are work vehicles that include four wheels rotatably mounted to a frame, an engine mounted on the frame and connected by a transmission to rotate at least two wheels, a cab compartment mounted on the frame that includes a seat for an operator, manual controls and a display panel disposed in the cab compartment, a boom arm assembly rotatably mounted on the frame and connected to a pair of hydraulic boom cylinders for moving the boom arm assembly, and an implement assembly connected to the boom arm assembly. Typically, one or more hydraulic cylinders are used to manipulate the implement assembly. The implement assembly may be, for example, a bucket assembly, wherein the implement is a bucket and a pair of hydraulic bucket cylinders is used to move the bucket assembly. Other types of work vehicles that are similar to skid steer loaders include tractors, bulldozers and mini-excavators.

To operate the hydraulic boom cylinders and the hydraulic bucket cylinders, an operator in the cab manipulates either hand or foot manual controls. The skid steer loader, or similar work vehicle, includes an electronic control circuit system that includes an onboard computer, microprocessor, or controller. For the purposes of this disclosure a computer, microprocessor, or controller are considered to be equivalent and interchangeable elements. The onboard computer operates solenoids or digital coils of electroliydraulic valves that activate the hydraulic boom and bucket cylinders.

To properly operate the hydraulic boom cylinders and the hydraulic implement cylinders, each manual control is associated with a control and position sensor that generates input signals and sends them to the controller. The input signals generated by each sensor correspond proportionately to a displacement of the particular manual control from a neutral position. Generally, the neutral position is memorized and stored in the memory storage unit that is either integral with, or connected to, the controller. The controller receives the control and position sensor input signals, compares the information provided by these sensors to the memorized neutral position data, then generates output control signals used to control the operation of electrohydraulic valves, such as spool valves or cartridge valves, Thus, the controlled operation of the electrohydraulic valves activates the hydraulic cylinders of the boom arm assembly and the implement assembly to effect movement of the boom arm assembly and the implement carried by the boom arm assembly. In this way, an operator directs the desired movement on the boom arm assembly and the implement by manipulating manual controls in the cab of the work vehicle.

One such work vehicle is the skid steer loaded disclosed in U.S. Pat. No. 5,924,516 to Sagaser et al., which is incorporated herein by reference in its entirety. Sagaser et al. discloses an electronic control system for a skid steer loader ("skidder") that includes a controller receiving inputs from an interface controller, position sensors associated with a hand grip and foot pedal manual controls, and a feedback signal from a linear actuator. The controller generates outputs to the linear actuator, which in turn activates a hydraulic spool valve that activates a hydraulic cylinder such as is connected to effect movement of a boom arm assembly or an implement carried by the boom arm assembly.

The hand grip and foot pedal manual controls are biased to a neutral position. The controller is programmed so that, upon power-up, the controller determines whether the manual controls are in a neutral position (or within some predetermined range of the neutral position) or not based on the data provided by position sensors associated with each manual control. If the manual controls are not in the neutral position, or not within some predetermined range of the neutral position, the controller sends a signal to the interface controller instructing the interface controller to inhibit certain operations of the loader until the manual controls are placed in the neutral position for some predetermined time period. In this manner, the loader is provided with a safety feature that prevents sudden and accidental operation of either the boom arm assembly and/or the implement assembly in case the operator starts up the loader with the manual controls significantly displaced from the neutral position.

However, the prior art work vehicles have certain drawbacks. First, the position information provided by the manual control and position sensors is susceptible to drift over time. Specifically, control and position sensors are partially sensitive to environmental changes such as variations in temperature. This dependence of each sensor on environmental factors is referred to as "sensor drift." Besides being partially temperature sensitive, the operational relationship between each control and position sensor and its associated manual control is partially sensitive to changes in the mechanical linkage between the manual controls and the sensors themselves. This dependence of the functioning of the sensor-manual control pair on the mechanical linkage between the sensor and the manual control is referred to, for the purposes of this disclosure, as "linkage drift." The ever changing problem caused by the naturally occurring "sensor drift," i.e., sensor signal fluctuation secondary to temperature changes, and some degree of "linkage drift," i.e., eventual changes over time in the mechanical linkage between the manual controls and the sensors themselves, is that the physical neutral position of the manual controls may not correspond precisely to the memorized neutral position. This drift in the physical neutral position from the memorized neutral position is referred to as "neutral drift" and is a function of, at least, sensor drift and linkage drift.

The prior art work vehicle has the disadvantage that the memorized neutral position stored in a memory storage device is fixed and there is no algorithm providing compensation for the neutral drift. The practical result of neutral drift is an eventual improper matching between the physical neutral position of the manual controls and the memorized neutral position stored in the memory storage device, which results in improper movement control of the boom arm assembly and/or the implement assembly when the physical neutral position is misperceived by the controller. Consequently, unexpected operation of the boom arm assembly and the implement assembly result as the manual controls are no longer precisely matched to movement in the boom arm assembly and implement assembly. In other words, the boom arm assembly and the implement can not be positioned as desired because the controller of the skid steer loader, or similar type of work vehicle, does not recognize when the manual controls are in the neutral position; therefore, the controller can not properly generate output control signals proportionate to the amount of displacement of the manual controls from the physical neutral position. Furthermore, when the controller can not properly recognize when the manual controls are in the neutral position, it becomes a more difficult task to get the controller to enable the operation of the boom arm assembly and the implement assembly instead of operating to inhibit operations of these assemblies.

From the previous discussion, it is clear that there is a need to correct for neutral drift. However, the particular amount of neutral drift between any one control and position sensor and its associated manual control is a physical limitation of the sensor and its mechanistic association with the manual control. In other words, the temperature dependence of any one particular control and position sensor is not readily predicable, and whatever play there is in the mechanical linkage between the sensor and its associated manual control is also unpredictable. Consequently, each sensor, paired to its manual control will form a system having unique neutral drift characteristics. Without extensive physical characterization of each individual sensor and characterization of the relationship with its associated manual control, it is impractical to confidently predict how much drift from the neutral position there will be with temperature changes and time related changes in the mechanical linkage between each sensor and its associated manual control. In other words, it is difficult or impractical to approach the problem of sensor neutral drift from the point of view of characterizing and correcting for each sensor and its mechanistic association with a manual control.

One object of the present invention is to overcome the disadvantages of the prior art electronic control systems for work vehicles and like machines.

Another object of the present invention is to provide an electronic control system for work vehicles, and like machines, that includes a feature for automatically correcting for neutral drift by using previously measured position sensor information collected at the moment of previous work vehicle start-ups and adding the most recently measured position sensor information collected at the moment of the present start-up to provide a "moving average" position that serves as the new neutral position of the manual controls for the work vehicle.

Another object of the present invention is to provide an electronic control system for work vehicles, and like machines, that permits the selection and enablement of either hand or foot manual controls to manipulate the boom arm assembly and the implement assembly, wherein neutral drift has been compensated for by the control system of the work vehicle.

Another object of the present invention is to provide an electronic control system for work vehicles, and like machines, that is practical and cost effective to manufacture.

Another object of the present invention is to provide an electronic control system for work vehicles, and like machines, that is both durable and reliable.

Although the electronic control system for work vehicles and like machines will be described for use in skid steer loaders and other similar work vehicles, another object of the present invention is to provide an electronic control system for machines having a boom arm assembly and an implement assembly connected to the boom assembly, wherein the machine can be a self-propelled vehicle or a stationary device.

SUMMARY OF THE INVENTION

In accordance with the above objects, thus is provided both method and apparatus embodiments in accordance with the present invention. In a first method embodiment in accordance with the present invention, a method of manual control neutral drift correction for a work vehicle is characterized by the steps of: (a) sensing a position of a first manual control using a first position sensor when an activation switch is activated, wherein the first position sensor generates a first input signal; (b) sending the first input signal to a controller; (c) retrieving a stored first manual control neutral position value from a memory unit; (d) calculating a first corrected manual control neutral position value using the controller, wherein the first corrected manual control neutral position value is calculated using the first input signal and the first manual control position value; and (e) utilizing the first corrected manual control neutral position value to generate a first control signal for operating a first electro-hydraulic valve, wherein the first control signal is generated by the controller to operate the first electro-hydraulic valve to effect movement of a first assembly.

In accordance with a second method embodiment of the present invention, the first method embodiment is further modified so that calculation of the first corrected manual control neutral position value is a weighted average calculated as a function of the first input signal and the first manual control position value. In accordance with a third method embodiment of the present invention, the second method embodiment is further modified so that the first corrected manual control neutral position value is the weighted average calculated using formula I:

$$NNA=[(PNA)*(n-1)+NNU)]/n \quad \text{(I)}$$

which is a moving average, where NNA is the first corrected manual control neutral position value, PNA is the first manual control neutral position value, NNU is the first input signal, and n=128.

In accordance with a fourth method embodiment of the present invention, the first method embodiment is further modified so that the first manual control is a right foot pedal manual control, the first position sensor is a right foot pedal implement position sensor, and the first assembly is an implement assembly, wherein the implement assembly moves when the first electro-hydraulic valve receives the first control signal.

In accordance with a fifth method embodiment of the present invention, the first method embodiment is further modified so that the first manual control is a left hand grip manual control, the first position sensor is a left hand stick boom arm position sensor, and the first assembly is a boom arm assembly, wherein the boom arm assembly moves when the first electro-hydraulic valve receives the first control signal.

In accordance with a sixth method embodiment of the present invention, the first method embodiment is further modified so that the first manual control is a left foot pedal manual control, the first position sensor is a left foot pedal boom arm position sensor, and the first assembly is a boom arm assembly, wherein the boom arm assembly moves when the first electro-hydraulic valve receives the first control signal.

In accordance with a seventh method embodiment of the present invention, the first method embodiment is further modified so that the first manual control is a right hand grip manual control, the first position sensor is a right hand stick implement position sensor, and the first assembly is an implement assembly, wherein the implement assembly moves when the first electro-hydraulic valve receives the first control signal.

In accordance with an eighth method embodiment of the present invention, the first method embodiment is further modified so that the first manual control is a hand grip manual control, and the first position sensor is a hand rip position sensor.

In accordance with a ninth method embodiment of the present invention, the first method embodiment is further modified so that the first manual control is a foot pedal manual control, and the first position sensor is a foot pedal position sensor.

In accordance with a tenth method embodiment of the present invention, the eighth method embodiment is further modified so that the first assembly is an implement assembly.

In accordance with an eleventh method embodiment of the present invention, the ninth method embodiment is further modified so that the first assembly is an implement assembly.

In accordance with a twelfth method embodiment of the present invention, the eighth method embodiment is further modified so that the first assembly is a boom arm assembly.

In accordance with a thirteenth method embodiment of the present invention, the ninth method embodiment is further modified so that the first assembly is a boom arm assembly.

In accordance with a fourteenth method embodiment of the present invention, the first method embodiment is further modified so that activating the activation switch enables the first manual control and disables a second manual control.

In accordance with a fifteenth method embodiment of the present invention, the fourteenth method embodiment is further modified so that the first manual control is a right hand grip manual control, the second manual control is a right foot pedal manual control, the first position sensor is a right hand stick implement position sensor, and the first assembly is an implement assembly, wherein the implement assembly moves when the first electro-hydraulic valve receives the first control signal.

In accordance with a sixteenth method embodiment of the present invention, the fourteenth method embodiment is further modified so that the first manual control is a right foot pedal manual control, the second manual control is a right hand grip manual control, the first position sensor is a right foot pedal implement position sensor, and the first assembly is an implement assembly, wherein the implement assembly moves when the first electro-hydraulic valve receives the first control signal.

In accordance with a seventeenth method embodiment of the present invention, the fourteenth method embodiment is further modified so that the first manual control is a left hand grip manual control, the second manual control is a left foot pedal manual control, the first position sensor is a left hand stick boom position sensor, and the first assembly is a boom arm assembly, wherein the boom arm assembly moves when the first electro-hydraulic valve receives the first control signal.

In accordance with an eighteenth method embodiment of the present invention, the fourteen method embodiment is further modified so that the first manual control is a left foot pedal manual control, the second manual control is a left hand grip manual control, the first position sensor is a left foot pedal boom position sensor, and the first assembly is a boom arm assembly, wherein the boom arm assembly moves when the first electro-hydraulic valve receives the first control signal.

In accordance with a nineteenth method embodiment of the present invention, the first method embodiment is further modified to include the steps of: (g) when the activation switch is activated, sensing a position of a second manual control using a second position sensor, sensing a position of a third manual control using a third position sensor, and sensing a position of a fourth manual control using a fourth position sensor, wherein the second position sensor generates a second input signal, the third position sensor generates a third input signal and the fourth position sensor generates a fourth input signal; (h) sending the second input signal, the third input signal and the fourth input signal to the controller; (i) retrieving a stored second manual control neutral position value, a stored third manual control neutral position value and a stored fourth manual control neutral position value from the memory unit; (j) calculating a second corrected manual control neutral position value using the controller, wherein the second corrected manual control neutral position value is calculated using the second input signal and the second manual control position value; (k) calculating a third corrected manual control neutral position value using the controller, wherein the third corrected manual control neutral position value is calculated using the third input signal and the third manual control position value; and (l) calculating a fourth corrected manual control neutral position value using the controller, wherein the fourth corrected manual control neutral position value is calculated using the fourth input signal and the fourth manual control position value.

In accordance with a twentieth method embodiment of the present invention, the nineteenth method embodiment is further modified to include the step of: (m) utilizing the second corrected manual control neutral position value to generate a second control signal for operating a second electro-hydraulic valve, wherein the second control signal is generated by the controller to operate the second electro-hydraulic valve to effect movement of a second assembly.

In accordance with a twenty-first method embodiment of the present invention, the twentieth method embodiment is further modified to include the step of: (n) storing the first corrected manual control neutral position value, the second corrected manual control neutral position value, the third corrected manual control neutral position value, and the fourth corrected manual control neutral position value in the memory unit.

In accordance with a twenty-second method embodiment of the present invention, the nineteenth method embodiment is further modified so that activating the activation switch enables the first manual control and the second manual control while disabling the third manual control and the fourth manual control.

In accordance with a twenty-third method embodiment of the present invention, the first method embodiment is further modified to include the step of: (f) storing the first corrected manual control neutral position value in the memory unit.

In a first apparatus embodiment in accordance with the present invention, a work vehicle is characterized by: (a) a frame; (b) a boom arm assembly connected at one end to the frame; (c) an implement assembly pivotally connected to another end of the boom arm assembly, wherein the implement assembly includes an implement; (d) a first hydraulic implement cylinder connected to the implement assembly and positioned to pivotally rotate the implement relative to the boom arm assembly when a piston of the first hydraulic implement cylinder is extended or retracted, wherein the first hydraulic implement cylinder is connected to a first electrohydraulic valve that activates extension and retraction of the piston of the first implement cylinder; (e) a second hydraulic boom cylinder connected to the boom arm assembly and positioned to move the boom arm assembly between a first retracted position and a second extended position when a piston of the second boom cylinder is retracted and extended, respectively, wherein the second hydraulic boom cylinder is connected to a second electrohydraulic valve that activates extension and retraction of the piston of the second hydraulic cylinder; (f) a first position sensor disposed to sense a position of a first manual control and generate a first input signal; (g) a second position sensor disposed to sense a position of a second manual control and generate a second input signal; (h) a controller connected to receive the first input signal from the first position sensor and the second input signal from the second position sensor, and connected to send a first control signal to the first electrohydraulic valve and a second control signal to the second electrohydraulic valve; and (i) an activation switch connected to send an activation signal to the controller, wherein when the activation signal is sent to the controller, the controller retrieves a first manual control neutral position value and a second manual control neutral position value from a memory storage device connected to provide stored data to the controller and the controller calculates a first corrected manual control neutral position value and a second corrected manual control neutral position value using the first input signal, the second input signal, the first manual control neutral position value and the second manual control neutral position value, wherein the controller generates the first control signal using the first corrected manual control neutral position value and generates the second control signal using the second corrected manual control neutral position value.

In accordance with a second apparatus embodiment of the present invention, the first apparatus embodiment is further modified to include a third position sensor disposed to sense a position of a third manual control and generate a third input signal; and a fourth position sensor disposed to sense a position of a fourth manual control and generate a fourth input signal, wherein the controller is connected to receive the third input from the third position sensor and to receive the fourth input from the fourth position sensor, wherein when the activation signal is sent to the controller, the controller retrieves a third manual control neutral position value and a fourth manual control neutral position value from the memory storage device connected to provide stored data to the controller and the controller calculates a third corrected manual control neutral position value and a fourth corrected manual control neutral position value using the third input signal, the fourth input signal, the third manual control neutral position value and the fourth manual control neutral position value.

In accordance with a third apparatus embodiment of the present invention, the second apparatus embodiment is further modified so that the first manual control and the second manual control are manual hand grip controls and the third manual control and the fourth manual controls are manual foot pedal controls, wherein the controller enables the first manual control and the second manual control and disables the third manual control and the fourth manual control in response to receiving the activation signal from the activation switch.

In accordance with a fourth apparatus embodiment of the present invention, the second apparatus embodiment is further modified so that the first manual control and the second manual control are manual foot pedal controls and the third manual control and the fourth manual controls are manual hand grip controls, wherein the controller enables the first manual control and the second manual control and disables the third manual control and the fourth manual control in response to receiving the activation signal from the activation switch.

In accordance with a fifth apparatus embodiment of the present invention, the second apparatus embodiment is further modified so that the memory storage device is integrally connected to the controller and forms a portion of the controller.

In accordance with a sixth apparatus embodiment of the present invention, the second apparatus embodiment is further modified so that the memory storage device is an external non-volatile memory unit connected to the controller.

Further objects, features, and advantages of the present invention will become apparent from the Detailed Description of Preferred Embodiments, which follows, when considered together with the attached drawings.

DETAILED DESCRIPTION OF PREFERRED EMBODIMENTS

Figure 3:
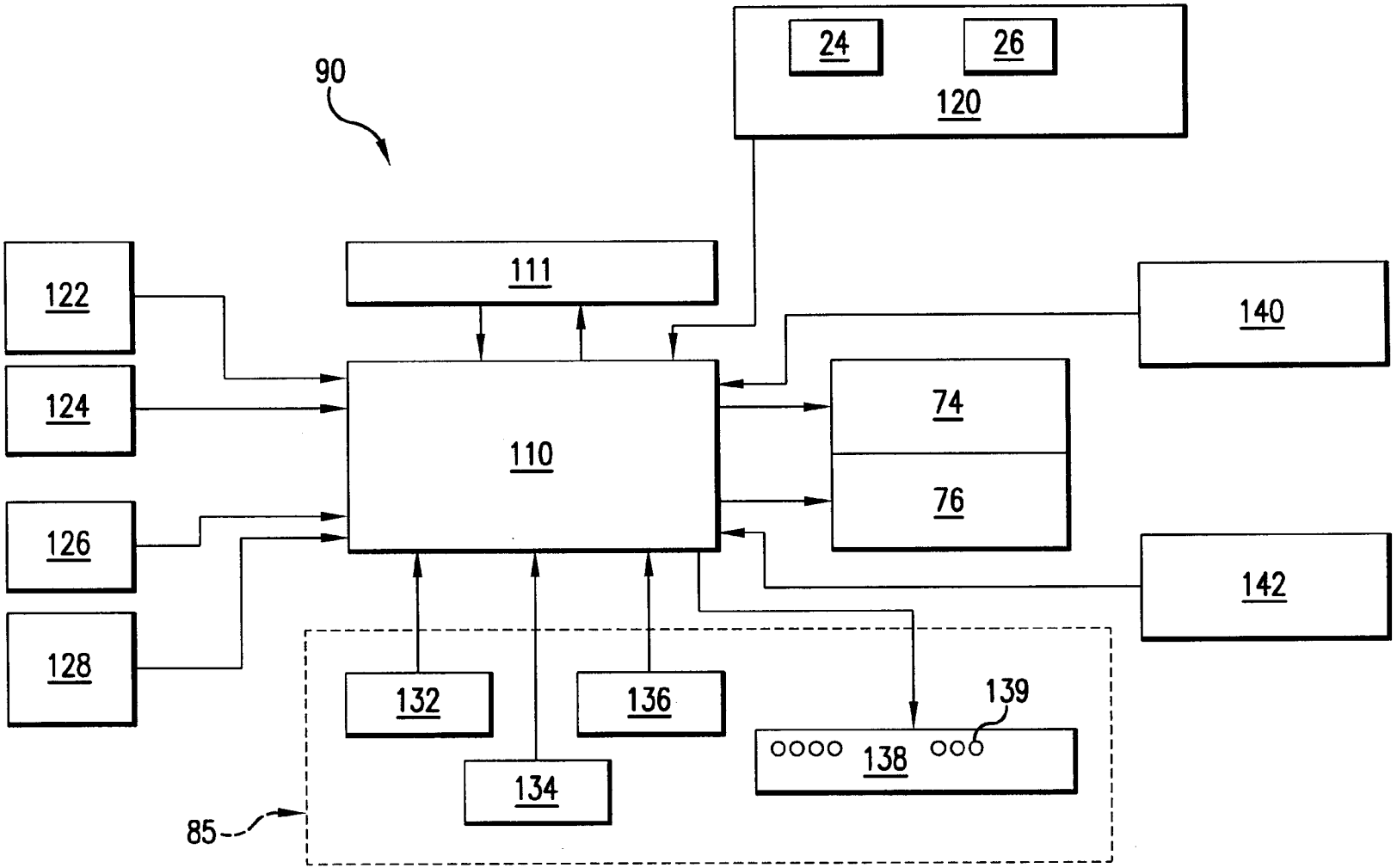
FIG. 3 is a schematic drawing of the control system of the present invention.
Figure 4:
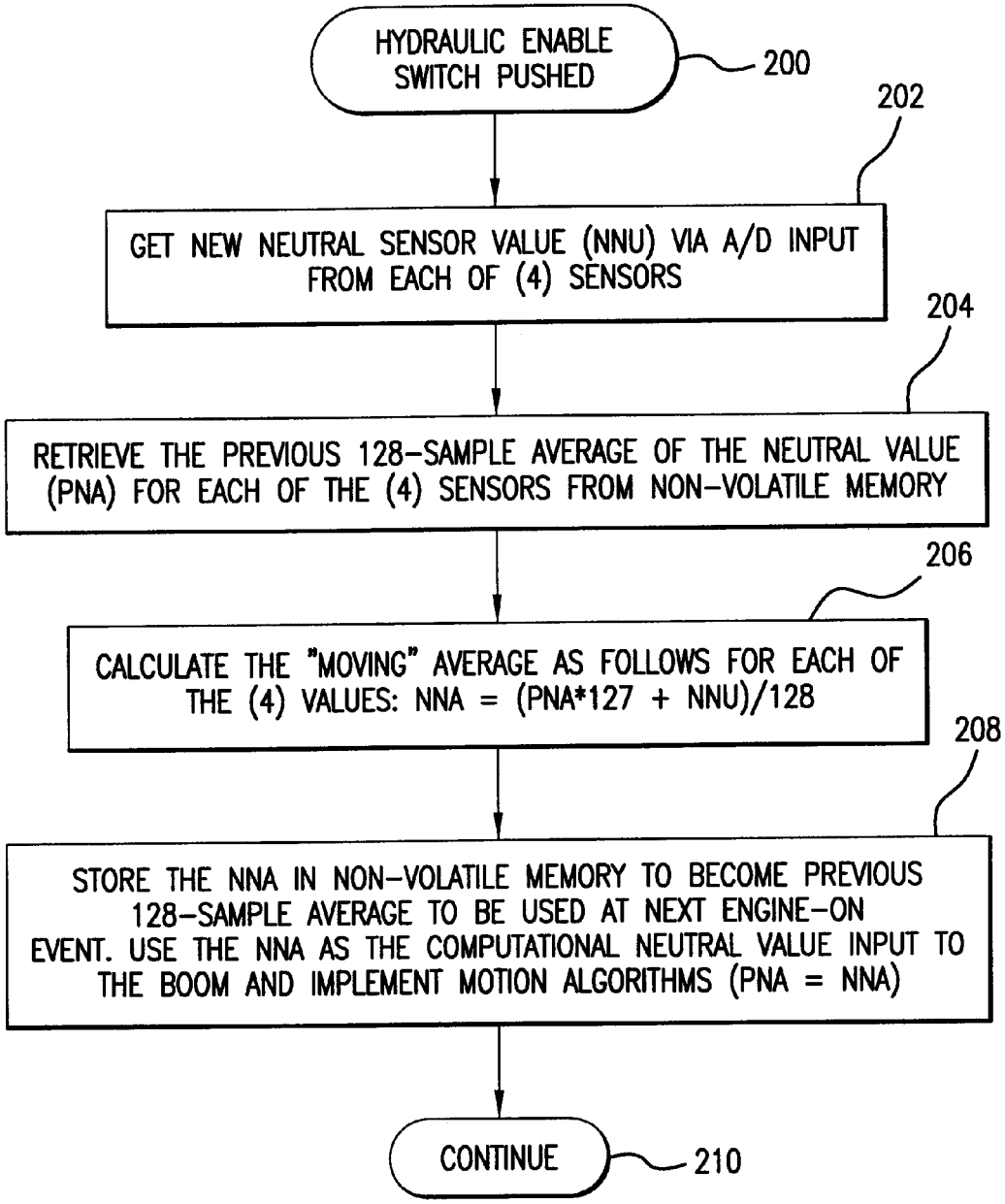
FIG. 4 is a flow diagram of the neutral position drift correction method in accordance with the present invention.

The preferred embodiments will now be described with reference to the figures in which like parts are indicated by like reference numerals. A neutral position drift correction method embodiment in accordance with the present invention is outlined in FIG. 4. An apparatus embodiment, shown in FIGS. 1–3, is constructed to perform the neutral position drift correction method and will be described first to facilitate an easy understanding of the method embodiment in accordance with the present invention.

Figure 1:
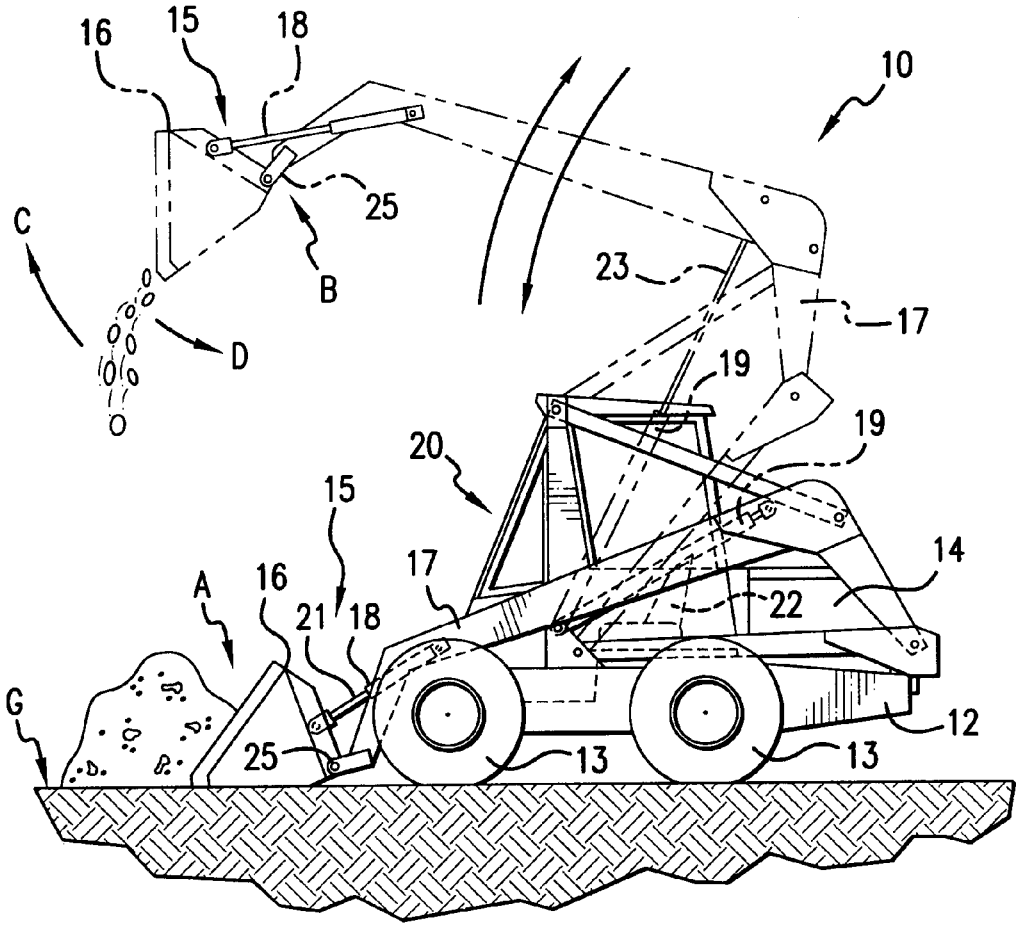
FIG. 1 schematically illustrates a side view of a work vehicle in accordance with the present invention.

FIG. 1 shows a compact work vehicle 10, such as a skid steer loader or other like work vehicle, that includes a cab compartment 20 on the vehicle. Typically, work vehicle 10 includes a body 12 that is mounted on four wheels 13 (only two shown) that are connected to be rotated by a transmission. The transmission is powered by an engine disposed in engine housing 14, located on the body 12. One skilled in the art would realize that the work vehicle 10 could be a tracked vehicle, a vehicle mounted on rails, or could be a machine mounted to a stationary frame without departing from the scope of the present invention.

Work vehicle 10 includes a boom arm assembly 17 that is pivotally connected to the body 10 at one end, and that is pivotally connected at its opposite end to a work implement assembly 15 that includes work implement 16 and pivotal connection 25. Work implement 16 can be any useful tool such as a loader bucket, snow blade, pallet forks attachment, digging auger, or other suitable tool. As shown in FIG. 1, boom arm assembly 17 can be raised and lowered between a lower position A and an upper position B (shown in phantom) through a range of motion using hydraulic power provided by a pair of hydraulic boom cylinders 19 (only one shown) of a hydraulic circuit (not shown) so that the implement 16 can be used to perform its intended function. The hydraulic circuit also powers one or more hydraulic implement cylinders 18 (only one shown) for moving and/or activating the implement 16. As shown in FIG. 1, implement 16 also can move when boom arm assembly 17 moves between position A and position B; however, the full range of motion of implement 16 is indicated by curling arrow C and dumping arrow D. In the case where the work vehicle is a skid steer loader, the implement 16 may be, for example a loader bucket and there is a pair of bucket cylinders for moving and/or activating the loader bucket.

Figure 2:
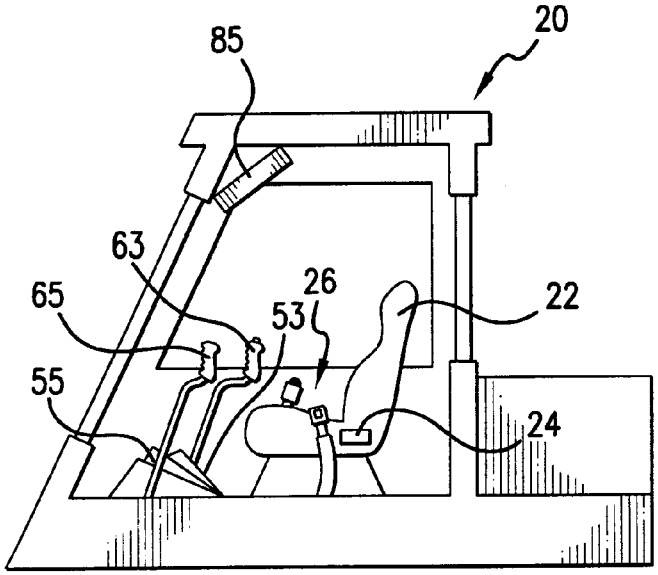
FIG. 2 schematically illustrates a side cutaway view of the cab compartment of the work vehicle in accordance with the present invention.

As shown in FIG. 2, inside of cab compartment 20 there is an operator's seat 22 upon which an operator sits while operating the work vehicle 10. Seat 22 is equipped with a seat pressure sensor or seat switch 24, such as described in U.S. Pat. Nos. 4,856,612 and 4,871,044, both of which are incorporated herein by reference for all they disclose. When seat 22 is empty, the seat switch 24 is open and when an operator sits in the seat 22, then the seat switch 24 is pressed into a closed state. Seat 22 is also equipped with a restraint seat belt switch 26 that includes a male end that matingly secures to a female end. When the male end and the female end are matingly secured together, then seat belt switch 26 is in the closed state. When the male end and the female end are not secured together, but are separate and apart, then seat belt switch 26 is in the open state.

Cab compartment 20 also includes, for example, a Total Control System display ("TCS display") 85 for displaying various light indicators, LEDs, gauges and the like, to inform the operator of the status of the various monitored systems carried by the work vehicle 10. Cab compartment 20 also has a pair of manual foot pedal controls 53 and 55 and a pair of manual hand grip controls 63 and 65 for operating the implement 16 and the boom arm assembly 17. Each manual control of hand grip controls 63, 65 and foot pedal controls 53, 55 is movable within a specific predetermined range of motion inside the cab compartment 20. Furthermore, each manual control is mechanically biased to a neutral position within its predetermined range of motion.

FIG. 3 illustrates the electrical connections between the various components of the electronic control system 90 in accordance with the present invention. Electronic control system 90 is carried by the work vehicle 10 and includes an on board controlling microprocessor (also referred to as the "controller") 110 connected to exchange data with a memory storage device 111. Preferably, memory storage device 111 is a non-volatile memory that stores the neutral positions of the manual foot pedal controls 53, 55 and the manual hand grip controls 63, 65 and other data that may be needed by the control system 90. Although controller 110 and memory storage device 111 are preferably separate structures, controller 110 can be constructed to incorporate the memory storage device without departing from the scope of the invention.

Controller 110 is connected to receive electronic signal inputs from the following devices: operator "seat belt switch and seat switch" circuit 120, right hand stick implement control and position sensor 122, left hand stick boom control and position sensor 124, right foot pedal implement control and position sensor 126, left foot pedal boom control and position sensor 128, hand/foot controls selector switch 132, vehicle tilt sensor 134, auxiliary feature selection switch 136, boom position sensor 140, and implement angle position sensor 142. Although many different types of controllers are suitable for use as the controller 110 in system 90 of the present invention, microcontroller C167CR manufactured by Infineon Technologies AG (Germany) is particularly well suited for use in the present system environment.

The operator "seat belt switch and seat switch" circuit 120 is an electronic circuit that generates an enabling signal when seat belt switch 26 and seat switch 24 are in the closed state (i.e., an operator is sitting in seat 22 and the male end of seat belt switch 26 is secured to the female end). Controller 110 is not enabled to produce control output signals until the seat belt switch and seat switch circuit 120 sends an enabling electronic input signal to the controller. Seat belt switch 26 and seat switch 24 are incorporated into the "seat belt switch and seat switch" circuit 120 as indicated in FIG. 3. One such circuit suitable for use as the seat belt switch and seat switch circuit 120 is disclosed in U.S. Pat. No. 4,871,044 to Strosser et al., which is incorporated herein by reference for all it contains.

The right hand stick implement control and position sensor 122 is an electronic position sensor that sends position information input signals to controller 110 reporting the position of the manual right hand grip control 63. The position of the manual right hand grip control 63 is sensed by sensor 122 that generates a signal sent to controller 110. Controller 110 processes the position information input signals provided by sensor 122 and uses the information to send control signals that operate electro-hydraulic implement cylinder valve 74. The electro-hydraulic implement valve 74 activates the hydraulic implement cylinders 18 to move pistons 21 thereby controlling the position of implement 16 relative to boom arm assembly 17. Pistons 21 move to extend and retract, thereby extending, (dumping) or retracting (curling) the implement 16 of implement assembly 15.

The left hand stick boom control and position sensor 124 is an electronic position sensor that sends position information input signals to controller 110 reporting the position of the manual left hand grip control 65. The position of the manual left hand grip control 65 is sensed by sensor 124 that generates a signal sent to controller 110. Controller 110 processes the position information input signals provided by sensor 124 and uses the information to operate the electro-hydraulic boom cylinder valve 76. The electro-hydraulic boom valve 76 activates the hydraulic boom cylinders 19 to move pistons 23 thereby controlling the position of boom assembly 17 relative to the work vehicle 10. Pistons 23 move to extend and retract, thereby extending or retracting the boom arm assembly 17.

The right foot pedal implement control and position sensor 126 is an electronic position sensor that sends position information input signals to controller 110 reporting the position of the manual right foot pedal control 53. The position of the manual right foot pedal control 53 is sensed by sensor 126 that generates a signal sent to controller 110. Controller 110 processes the position information input signals provided by sensor 126 and uses the information to operate electro-hydraulic implement cylinder valve 74. The electro-hydraulic implement valve 74 activates the hydraulic implement cylinders 18 to move pistons 21 thereby controlling the position of implement 16 relative to boom assembly 17. Pistons 21 move to extend and retract, thereby extending (dumping) or retracting (curling) the implement 16 of implement assembly 15.

The left foot pedal boom control and position sensor 128 is an electronic position sensor that sends position information input signals to controller 110 reporting the position of the manual left foot pedal control 55. The position of the manual left foot pedal control 55 is sensed by sensor 128 that generates a signal sent to controller 110. Controller 110 processes the position information input signals provided by sensor 128 and uses the information to operate electro-hydraulic boom cylinder valve 76. The electro-hydraulic boom cylinder valve 76 activates the hydraulic boom cylinders 19 to move pistons 23 thereby controlling the position of boom assembly 17 relative to the work vehicle 10. Pistons 23 move to extend and retract, thereby extending or retracting the boom arm assembly 17.

Preferably, the electrohydraulic valves 74 and 76 are solenoid operated hydraulic spool valves or digital coil operated hydraulic cartridge valves. When solenoid operated hydraulic spool valves are used, control and position sensors 122, 124, 126 and 128 are potentiometers or resistive strip-type position sensors that generate analog output signals ranging from +0.5 to +4.5V. However, when digital coil operated cartridge valves are used, control and position sensors can be used that generate digital output signals.

The hand/foot controls selector switch 132 is an electronic switch that operates to send input signals to controller 110, and controller 110 uses this input signal to enable either the manual hand grip controls 63, 65 or the manual foot pedal controls 53, 55. Thus, in a first state, switch 132 has enabled or activated control system 90 to use the manual hand grip controls 63, 65 and disables or deactivates the manual foot pedal controls 53, 55. When switch 132 has enabled the first state, only the right and left manual hand grip controls 63, 65 can be used by the operator to effect operation of the electro-hydraulic valves 74 and 76 to activate the implement cylinders 18 and the boom cylinders 19, respectively. In a second state, switch 132 has enabled or activated the manual foot pedal controls 53, 55 and disables or deactivates the manual hand grip controls 63, 65. When switch 132 has enabled the second state, only the right and left manual foot pedal controls 53, 55 can be used to effect operation of the electro-hydraulic valves 74 and 76 to activate the implement cylinders 18 and the boom cylinders 19, respectively.

Preferably, switch 132 is constructed as a pressure sensing switch that sends a generic input signal to controller 110. In addition, controller 110 operates functionally to provide control system 90 with a third state, wherein neither the manual hand grip controls 63, 65 nor the manual foot pedal controls 53, 55 are enabled. It is desirable that the controller 110 initialize the work vehicle 10 to default to the third state upon initial start-up so as to avoid accidental operation of the boom arm assembly 17 and the implement 16. After start-up, switch 132 can be used to select the first state or the second state. Preferably, switch 132 can be used thereafter to switch between the first, second and third states as desired. When switch 132 is used to select the third state, the boom arm assembly 17 and the implement 16 will not be operable. This condition is desirable when accidental operation of the boom arm assembly 17 and implement 16 is to be avoided, such as when driving the work vehicle 10 a relatively long distance from one work site to another work site.

Vehicle tilt sensor 134 is an electronic sensing circuit that provides signal output to controller 110 indicating the relative orientation of the work vehicle 10 with respect to the Earth's horizon. Tilt sensor 134 provides position information data regarding the position of the work vehicle 10 relative to the horizontal plane of the Earth's horizon and inputs this information into controller 110. Controller 110 can use this information in various operational algorithms.

The boom position sensor 140 is an electronic position sensor that is carried by the boom arm assembly 17 and provides an input signal to the controller 110 indicating the height of the boom assembly relative to the work vehicle 10. Likewise, implement angle position sensor 142 is an electronic position sensor that is carried by the boom arm assembly 17 and that provides an input signal to the controller 110 indicating the angular position of the implement 16 relative to the work vehicle 10. Controller 110 can be optionally preprogrammed to utilize signal input from boom position sensor 140 and implement angle position sensor 142 in accordance with various optional control algorithms for the boom arm assembly 17 and the implement assembly 15.

Controller 110 is connected to send electronic output signals for control purposes, or for display purposes, depending upon the nature of the device receiving the output signals from the controller. Specifically, controller 110 is connected to send electronic control signals to electro-hydraulic valves 74 and 76. Electronic control signals sent to boom cylinder valve 76 effects proportional control of hydraulic flow according to displacement of the left side operator manual controls, (i.e., either left foot control 55 or left hand control 65), so that electro-hydraulic valve 76 activates both boom cylinders 19. Boom cylinders 19 collectively move the boom assembly 17 between different positions, such as positions A and B shown in FIG. 1. Controller 110 also sends electronic control signals to implement cylinder valve 74 to effect proportional control of hydraulic flow according to displacement of the right side operator manual controls, (i.e., either right foot control 53 or right hand control 63), so the electro-hydraulic implement valve 74 activates the implement cylinders 18. Implement cylinders 18 collectively move or rotate implement 16 relative to the boom assembly 17.

Analog signals generated by hand control and position sensors 122, 124 and foot control and position sensors 126, 128 are proportional to the displacement of the manual hand grip controls 63, 65 and manual foot pedal controls 53, 55, respectively, from a neutral position stored in the memory storage device or unit 111. Memory storage device or unit 111 is preferably a non-volatile memory storage device or unit that is either externally connected to controller 110 or is integrally connected to controller 110 and forming a portion of the controller. Based upon the magnitude of displacement of each manual control 53, 55, 63, and 65 from the memorized neutral position, controller 10 routes hydraulic fluid flow in a proportional manner using electro-hydraulic valves 74 and 76 to effect movement of implement 16 and boom arm assembly 17. What the operator in the cab perceives is that displacement of the enabled manual controls, whether 53, 55 or 63, 65, affects both the velocity of movement and the position of the implement 16 and the boom arm assembly 17.

Controller 110 is also connected to send electronic output display signals for activating indicators 139 on a status display 138. Preferably, indicators 139 are LEDs or light bulbs that light up when activated by output signals from controller 110; however, indicators 139 can also be electronic gauges and the like for displaying information useful to an operator of the work vehicle 10.

Status display 138 is disposed on a portion of the TCS display 85 as shown in FIG. 3. TCS display 85 also includes the hand/foot controls selector switch 132, the vehicle tilt sensor 134, and the special mode selection switch 136. As shown in FIG. 2, the TCS display 85 is positioned in cab 20 so as to be readily observable by the vehicle operator. Preferably, the TCS display 85 is located in the upper front portion of cab 20, although other locations in the cab are suitable so long as the TCS display 85 is readily observable by the vehicle operator.

Having described the components of electronic control system 90 for controlling movement of boom assembly 17 and implement 16 in full detail, it is easy to understand the theory of operation for the control system 90. Upon power-up of work vehicle 10, controller 110 prevents operator control over the boom assembly 17 and the implement 16 until the following enabling conditions are met: (a) the operator is seated in seat 22, thereby closing seat switch 24; (b) restraint belt switch 26 is in the closed state (i.e., male end is secured to female end); and (c) the hand/foot controls selector switch 132 is activated to select one of the first and second states. When conditions (a), (b) and (c) are met, then controller 110 automatically initiates a neutral drift correction algorithm pre-programmed into the controller.

The method of the neutral drift correction algorithm is described as follows. First step 200 begins after the work vehicle 10 has been started up by an operator and enabling conditions (a) and (b) described above have been met. In the first step 200, an operator selects and enables either the paired manual hand grip controls 63, 65 or the paired manual foot pedal controls 53, 55 using the hand/foot controls selector switch 132. Once a paired set of manual controls has been enabled by activating hand/foot controls selector switch 132, the method moves from step 200 to step 202. In step 202, controller 110 receives a new set of control and position sensor input data from each control and position sensor 122, 124, 126, and 128. For example, when the manual hand grip controls 63, 65 are enabled, control and position sensors 122, 124, 126, and 128 generate and send a new set of control and position sensor input data that is used by controller 110. This method, of course, assumes that each manual control is biased to a neutral position and that the operator is doing nothing at the moment to displace any of the manual controls from this biased neutral position.

The new set of control and position sensor input data should correspond to, or be approximately representing, the biased neutral control position for the four manual controls and are referred to as the "new neutral sensor values" (NNU). The new neutral sensor values (NNU) are sensor input data signals and there are four of them in a set. In the next step 204, controller 110 then retrieves the four memorized and stored "average neutral values" (PNA), which are averaged manual control neutral position values, from the memory storage device 111, where there is a PNA value stored in the memory storage device corresponding to each one of the control and position sensors 122, 124, 126, and 128. Theoretically, each PNA represents, for example, a 128-sample average of the neutral sensor value for one of the four control and position sensors. In actuality, each PNA is determined and stored in the memory storage device or unit 111 at the time of manufacture and the controller 110 subsequently operates to calculate weighted averages for the neutral position as described in the next step.

Step 206 follows step 204. In step 206, controller 110 calculates the updated or new "moving average" (NNA) of the neutral sensor value as follows:

$$NNA_1=[(PNA_{i-1})*(n-1)+NNU\ i)]/n,$$

for each of the four sensors 122, 124, 126, and 128, where $NNA_1$ is the ith iteration of the calculation for one sensor, NNUi is the ith new neutral sensor value measured by the sensor, $PNA_{i-1}$ is the previously calculated averaged neutral value (i.e., $NNA_{i-1}$) that would be stored in the memory storage device 111, and n is an arbitrarily chosen integer. For practicing the invention, a value of n=128 is adequate for the calculation's purpose, although other values of n would suffice. When n=128, NNA is a weighted average wherein the NNU makes up only $1/128^{th}$ of the weighted average and the previously stored PNA makes up $127/128^{th}$ of the weighted average. The NNA are the corrected manual control neutral position values that have been corrected using the measured manual neutral position values measured in step 202 that were averaged in step 206 with the previously calculated averaged neutral values retrieved from memory in step 204.

Step 208 follows step 206. In step 208, the newly calculated NINA is stored in the non-volatile memory storage device 111 as the $PNA_i$, and the previous $PNA_{i-1}$ is discarded. In other words, in step 208, $NNA_i=PNA_i$. This memorization procedure is done for each of the four sensors.

In step 210, controller 110 uses the four values of $PNA_i$ as the sensor values corresponding to the neutral positions of the four manual controls. In this method, each start-up generates neutral position sensor input data that contributes a very small amount to the new moving average of the neutral sensor value NNA; however, over time any significant drift in the neutral position due to prolonged changes in environmental conditions will be accounted for as the control system corrects for this change. For example, if the work vehicle is operated in hot, dry desert conditions for awhile and then transported to a cold, wet wintery climate, the neutral position may shift appreciably due to the effects of the climate on the sensors 122, 124, 126, and 128. However, as the work vehicle 10 undergoes successive start-ups the neutral drift correction algorithm in accordance with the present invention slowly corrects for these system changes using the weighted average NNA. Consequently, a new PNA is defined and stored in the memory storage device 111 that corresponds to the new neutral positions for the four manual controls in the new environment.

In accordance with the present invention, step 200 repeats upon each new start-up of the work vehicle 10 so that the method of neutral drift correction cycles through steps 200 to 210.

While the present invention has been described with reference to certain preferred embodiments, one of ordinary skill in the art will recognize that additions, deletions, substitutions, modifications and improvements can be made while remaining within the spirit and scope of the present invention as defined by the appended claims.

What is claimed is:

1. A method of manual control neutral drift correction for a work vehicle, comprising the steps of:

(a) sensing a position of a first manual control using a first position sensor when an activation switch is activated, wherein the first position sensor generates a first input signal;

(b) sending the first input signal to a controller;

(c) retrieving a stored first manual control neutral position value from a memory unit;

(d) calculating a first corrected manual control neutral position value using the controller, wherein the first corrected manual control neutral position value is calculated using the first input signal and the first manual control position value; and (e) utilizing the first corrected manual control neutral position value to generate a first control signal for operating a first electro-hydraulic valve, wherein the first control signal is generated by the controller to operate the first electro-hydraulic valve to effect movement of a first assembly.

2. A method of manual control neutral drift correction as recited in claim 1, wherein calculation of the first corrected manual control neutral position value is a weighted average calculated as a function of the first input signal and the first manual control position value.

3. A method of manual control neutral drift correction as recited in claim 2, wherein the first corrected manual control neutral position value is the weighted average calculated using formula I:

$$NNA=[(PNA)*(n-1)+NNU)]/n \quad (I)$$

which is a moving average, where NNA is the first corrected manual control neutral position value, PNA is the first manual control neutral position value, NNU is the first input signal, and n=128.

4. A method as recited in claim 1, wherein the first manual control is a right foot pedal manual control, the first position sensor is a right foot pedal implement position sensor, and the first assembly is an implement assembly, wherein the implement assembly moves when the first electro-hydraulic valve receives the first control signal.

5. A method as recited in claim 1, wherein the first manual control is a left hand grip manual control, the first position sensor is a left hand stick boom arm position sensor, and the first assembly is a boom arm assembly, wherein the boom arm assembly moves when the first electro-hydraulic valve receives the first control signal.

6. A method as recited in claim 1, wherein the first manual control is a left foot pedal manual control, the first position sensor is a left foot pedal boom arm position sensor, and the first assembly is a boom arm assembly, wherein the boom arm assembly moves when the first electro-hydraulic valve receives the first control signal.

7. A method as recited in claim 1, wherein the first manual control is a right hand grip manual control, the first position sensor is a right hand stick implement position sensor, and the first assembly is an implement assembly, wherein the implement assembly moves when the first electro-hydraulic valve receives the first control signal.

8. A method according to claim 1, wherein the first manual control is a hand grip manual control, and the first position sensor is a hand grip position sensor.

9. A method according to claim 1, wherein the first manual control is a foot pedal manual control, and the first position sensor is a foot pedal position sensor.

10. A method according to claim 8, wherein the first assembly is an implement assembly.

11. A method according to claim 9, wherein the first assembly is an implement assembly.

12. A method according to claim 8, wherein the first assembly is a boom arm assembly.

13. A method according to claim 9, wherein the first assembly is a boom arm assembly.

14. A method as recited in claim 1, wherein activating the activation switch enables the first manual control and disables a second manual control.

15. A method of manual control neutral drift correction as recited in claim 14, wherein the first manual control is a right hand grip manual control, the second manual control is a right foot pedal manual control, the first position sensor is a right hand stick implement position sensor, and the first assembly is an implement assembly, wherein the implement assembly moves when the first electro-hydraulic valve receives the first control signal.

16. A method of manual control neutral drift correction as recited in claim 14, wherein the first manual control is a right foot pedal manual control, the second manual control is a right hand grip manual control, the first position sensor is a right foot pedal implement position sensor, and the first assembly is an implement assembly, wherein the implement assembly moves when the first electro-hydraulic valve receives the first control signal.

17. A method as recited in claim 14, wherein the first manual control is a left hand grip manual control, the second manual control is a left foot pedal manual control, the first position sensor is a left hand stick boom position sensor, and the first assembly is a boom arm assembly, wherein the boom arm assembly moves when the first electro-hydraulic valve receives the first control signal.

18. A method as recited in claim 14, wherein the first manual control is a left foot pedal manual control, the second manual control is a left hand grip manual control, the first position sensor is a left foot pedal boom position sensor, and the first assembly is a boom arm assembly, wherein the boom arm assembly moves when the first electro-hydraulic valve receives the first control signal.

19. A method as recited in claim 1, further comprising the steps of:

(f) when the activation switch is activated, sensing a position of a second manual control using a second position sensor, sensing a position of a third manual control using a third position sensor, and sensing a position of a fourth manual control using a fourth position sensor, wherein the second position sensor generates a second input signal, the third position sensor generates a third input signal and the fourth position sensor generates a fourth input signal;

(g) sending the second input signal, the third input signal and the fourth input signal to the controller;

(h) retrieving a stored second manual control neutral position value, a stored third manual control neutral position value and a stored fourth manual control neutral position value from the memory unit;

(i) calculating a second corrected manual control neutral position value using the controller, wherein the second corrected manual control neutral position value is calculated using the second input signal and the second manual control position value;

(j) calculating a third corrected manual control neutral position value using the controller, wherein the third corrected manual control neutral position value is calculated using the third input signal and the third manual control position value; and (k) calculating a fourth corrected manual control neutral position value using the controller, wherein the fourth corrected manual control neutral position value is calculated using the fourth input signal and the fourth manual control position value.

20. A method as recited in claim 19, further comprising the step of:

(l) utilizing the second corrected manual control neutral position value to generate a second control signal for operating a second electro-hydraulic valve, wherein the second control signal is generated by the controller to operate the second electro-hydraulic valve to effect movement of a second assembly.

21. A method as recited in claim 20, further comprising the step of:

(m) storing the first corrected manual control neutral position value, the second corrected manual control neutral position value, the third corrected manual control neutral position value, and the fourth corrected manual control neutral position value in the memory unit.

22. A method of manual control neutral drift correction as recited in claim 19, wherein activating the activation switch enables the first manual control and the second manual control while disabling the third manual control and the fourth manual control.

23. A method as recited in claim 1, further comprising the step of:

(f) storing the first corrected manual control neutral position value in the memory unit.

24. A work vehicle comprising:

a frame;

a boom arm assembly connected at one end to the frame; an implement assembly pivotally connected to another end of the boom arm assembly, wherein the implement assembly includes an implement;

a first hydraulic implement cylinder connected to the implement assembly and positioned to pivotally rotate the implement relative to the boom arm assembly when a piston of the first hydraulic implement cylinder is extended or retracted, wherein the first hydraulic implement cylinder is connected to a first electrohydraulic valve that activates extension and retraction of the piston of the first implement cylinder;

a second hydraulic boom cylinder connected to the boom arm assembly and positioned to move the boom arm assembly between a first retracted position and a second extended position when a piston of the second boom cylinder is retracted and extended, respectively, wherein the second hydraulic boom cylinder is connected to a second electrohydraulic valve that activates extension and retraction of the piston of the second hydraulic cylinder;

a first position sensor disposed to sense a position of a first manual control and generate a first input signal;

a second position sensor disposed to sense a position of a second manual control and generate a second input signal;

a controller connected to receive the first input signal from the first position sensor and the second input signal from the second position sensor, and connected to send a first control signal to the first electrohydraulic valve and a second control signal to the second electrohydraulic valve; and an activation switch connected to send an activation signal to the controller, wherein when the activation signal is sent to the controller, the controller retrieves a first manual control neutral position value and a second manual control neutral position value from a memory storage device connected to provide stored data to the controller and the controller calculates a first corrected manual control neutral position value and a second corrected manual control neutral position value using the first input signal, the second input signal, the first manual control neutral position value and the second manual control neutral position value, wherein the controller generates the first control signal using the first corrected manual control neutral position value and generates the second control signal using the second corrected manual control neutral position value.

25. A work vehicle as recited in claim 24, further comprising: a third position sensor disposed to sense a position of a third manual control and generate a third input signal; and a fourth position sensor disposed to sense a position of a fourth manual control and generate a fourth input signal, wherein the controller is connected to receive the third input from the third position sensor and to receive the fourth input from the fourth position sensor, wherein when the activation signal is sent to the controller, the controller retrieves a third manual control neutral position value and a fourth manual control neutral position value from the memory storage device connected to provide stored data to the controller and the controller calculates a third corrected manual control neutral position value and a fourth corrected manual control neutral position value using the third input signal, the fourth input signal, the third manual control neutral position value and the fourth manual control neutral position value.

26. A work vehicle as recited in claim 25, wherein the first manual control and the second manual control are manual hand grip controls and the third manual control and the fourth manual controls are manual foot pedal controls, wherein the controller enables the first manual control and the second manual control and disables the third manual control and the fourth manual control in response to receiving the activation signal from the activation switch.

27. A work vehicle as recited in claim 25, wherein the first manual control and the second manual control are manual foot pedal controls and the third manual control and the fourth manual controls are manual hand grip controls, wherein the controller enables the first manual control and the second manual control and disables the third manual control and the fourth manual control in response to receiving the activation signal from the activation switch.

28. A work vehicle as recited in claim 25, wherein the memory storage device is integrally connected to the controller and forms a portion of the controller.

29. A work vehicle as recited in claim 25, wherein the memory storage device is an external non-volatile memory unit connected to the controller.

* * * * *